US005909080A

United States Patent [19]

Uchida et al.

[11] Patent Number: 5,909,080

[45] Date of Patent: Jun. 1, 1999

[54] COLOR CATHODE RAY TUBE HAVING A SMALL NECK DIAMETER

[75] Inventors: Go Uchida; Shoji Shirai; Kazuhisa Oshita, all of Mobara, Japan

[73] Assignee: Hitachi, Ltd., Tokyo, Japan

[21] Appl. No.: 09/184,005

[22] Filed: Nov. 2, 1998

Related U.S. Application Data

[63] Continuation of application No. 08/916,666, Aug. 22, 1997, Pat. No. 5,847,502, which is a continuation of application No. 08/580,529, Dec. 28, 1995, Pat. No. 5,710,480.

[30] Foreign Application Priority Data

Jan. 9, 1995 [JP] Japan ..... 7-1309

[51] Int. Cl.[6] ..... H01J 29/51; H01J 29/62

[52] U.S. Cl. ..... 313/414; 313/412; 313/460

[58] Field of Search ..... 313/414, 412, 313/415, 425, 428, 432, 439, 449, 458, 460; 315/382, 382.1, 14, 15, 368.15

[56] References Cited

U.S. PATENT DOCUMENTS

| | | | |
|---|---|---|---|
| 4,581,560 | 4/1986 | Shirai et al. . | |
| 4,851,741 | 7/1989 | Shirai et al. . | |
| 5,025,189 | 6/1991 | Son . | |
| 5,142,189 | 8/1992 | Sugahara et al. . | |
| 5,212,423 | 5/1993 | Noguchi et al. . | |
| 5,281,896 | 1/1994 | Bae et al. . | |
| 5,300,855 | 4/1994 | Kweon . | |
| 5,488,265 | 1/1996 | Chen . | |
| 5,731,657 | 3/1998 | Uchida et al. | 313/412 X |

*Primary Examiner*—Ashok Patel

*Attorney, Agent, or Firm*—Antonelli, Terry, Stout & Kraus, LLP

[57] ABSTRACT

A color cathode ray tube includes an evacuated envelope formed of a panel portion having a phosphor screen, a neck portion and a funnel portion connecting the panel portion and the neck portion, and an in-line electron gun housed in the neck portion. The in-line electron gun includes a main lens and an electrostatic quadrupole lens. The focus electrode of the electron gun has a single opening at one end thereof for passing the three electron beams and opposes an anode to form a main lens therebetween. The single opening has a diameter larger in a horizontal direction than a diameter thereof in a vertical direction. A distance from the main lens to the phosphor screen is not larger than 300 mm, an outer diameter T of the neck portion housing the in-line electron gun satisfies the following inequality: 23.2 mm≦T≦25.9 mm, and a value D of twice a distance from a center of a trajectory of a side electron beam of the three electron beams to a horizontal edge of the single opening satisfies the following inequality: 5.0 mm≦D≦6.5 mm.

10 Claims, 9 Drawing Sheets

COLOR CATHODE RAY TUBE HAVING A SMALL NECK DIAMETER

CROSS REFERENCE TO RELATED APPLICATIONS:

This is a continuation of U.S. application Ser. No. 08/916,666, filed Aug. 22, 1997, now U.S. Pat. No. 5,847,502, which is a continuation of U.S. application Ser. No. 08/580,529, filed Dec. 28, 1995, now U.S. Pat. No. 5,710,480, the subject matter of which is incorporated by reference herein.

BACKGROUND OF THE INVENTION

The present invention relates to a cathode ray tube and particularly to a cathode ray tube having an in-line electron gun structured so as to project three electron beams in a horizontal plane toward the phosphor screen.

As a picture display means in a television receiver or a monitor terminal, a cathode ray tube having a plurality of in-line electron beams, that is, a color cathode ray tube is widely used.

A cathode ray tube of this kind comprises at least an evacuated envelope including a panel portion with a phosphor screen on its inner surface and a neck portion and a funnel portion connecting the panel portion and the neck portion, a deflection device mounted in the transition region between the funnel portion and the neck portion of the evacuated envelope, and an in-line electron gun structured so as to project three electron beams in a horizontal plane toward the phosphor screen and housed in the neck portion.

FIG. 8 is a schematic view illustrating the electrode constitution of an in-line electron gun used for a cathode ray tube of this kind and FIGS. 9A and 9B are illustrations of the essential electrodes of the electron gun shown in FIG. 8. In the drawings, numeral 1 indicates a cathode, 2 a control electrode, 3 an accelerating electrode, 4 a first focus electrode, 4*a* an internal electrode placed in the first focus electrode 4, 5 a second focus electrode, 5*a* and 5*b* parallel electrodes for forming an electrostatic quadrupole lens, 6 a plate electrode placed in the second focus electrode 5, 7 an anode, and 8 a plate electrode placed in the anode 7.

FIG. 9A is a cross sectional view along the line 100—100 in FIG. 8, and FIG. 9B is a cross sectional view along the line 101—101 in FIG. 8, and each same numeral as that shown in FIG. 8 corresponds to the same part.

As shown in FIG. 9A, the free ends of a pair of the parallel electrodes 5*a* and 5*b* attached to the second electrode 5 on the side of the first focus electrode 4 extend into the single opening formed in the first focus electrode 4 and sandwich vertically in non-touching fashion three in-line electron beam apertures $\mathbf{4}_1$, $\mathbf{4}_2$, and $\mathbf{4}_3$ formed in the internal electrode 4*a* placed in the first focus electrode 4.

In the plate electrode 6 placed in the second focus electrode 5, as shown in FIG. 9B, one elliptical aperture through which the center electron beam passes and semi-elliptical cutouts on both sides thereof are provided.

A cathode ray tube having an electron gun of the aforementioned constitution operates as follows:

Thermoelectrons emitted from the three cathodes heated by a heater are attracted toward the control electrode 2 by a positive voltage of 200 to 1000 V applied to the accelerating electrode 3 and form three electron beams.

The three electron beams pass through the apertures of the control electrode 2 and then the apertures of the accelerating electrode 3, and enters the main lens accelerated by the positive voltages applied to the first focus electrode 4, the second focus electrode 5, and the anode 7. Before the electron beams enter the main lens, a slight focusing action is exerted on them by a prefocus lens formed between the accelerating electrode 3 supplied with a low voltage of about 200 to 1000 V and the first focus electrode 4.

Furthermore, the second focus electrode 5 constituting the main lens is supplied with a low voltage of about 5 to 10 kV which is the same that of the first focus electrode 4, superposed with a dynamic voltage varying with an increase in the deflection angle of the electron beams and the anode 7 is supplied with a high voltage of about 20 to 35 kV.

An electrostatic quadrupole lens is formed on the opposing surfaces of the first focus electrode 4 and the second focus electrode 5 so as to correct for degradation of the focus characteristic at the screen corners caused by the deflection of the electron beams.

By the main lens formed by the potential difference between the second focus electrode 5 and the anode 7, the electron beams are focused on the phosphor screen and form beam spots on the screen.

The main causes for degradation of the focus characteristic which increases as the deflection angle of the electron beams increases are that firstly, since a self-converging deflection yoke is generally used to scan the electron beams on the phosphor screen, astigmatism is generated due to nonhomogeneity of its magnetic deflection field and secondly, since the distance from the main lens to the screen corners is longer than the distance from the main lens to the screen center, the electron beam focusing condition is different between the screen center and the screen corners.

Therefore, to solve the problem that the resolution deteriorates at the screen corners, an electron gun is structured to form an electrostatic quadrupole lens as shown in FIG. 9A and to receive a dynamic voltage varying with an increase in the deflection angle of the electron beams on the second focus electrode 5.

A prior art electron gun and a prior art cathode ray tube of this kind are disclosed in Japanese Patent Application Laid-open Sho 58-103752, which corresponds to U.S. Pat. No. 4,581,560, and Japanese Patent Application Laid-Open 2-72546, which corresponds to U.S. Pat. No. 4,851,741.

SUMMARY OF THE INVENTION

In a cathode ray tube using a conventional in-line electron gun of the aforementioned constitution, particularly a high definition color cathode ray tube for an information terminal, a problem arises that the power consumption of the deflection yoke increases with an increase in the deflection frequency for high definition display.

When the outer neck diameter is reduced from a conventional value of 29.1 mm, the deflection sensitivity of the deflection yoke is improved, though a problem as described below arises due to this reduction.

Figure 10:
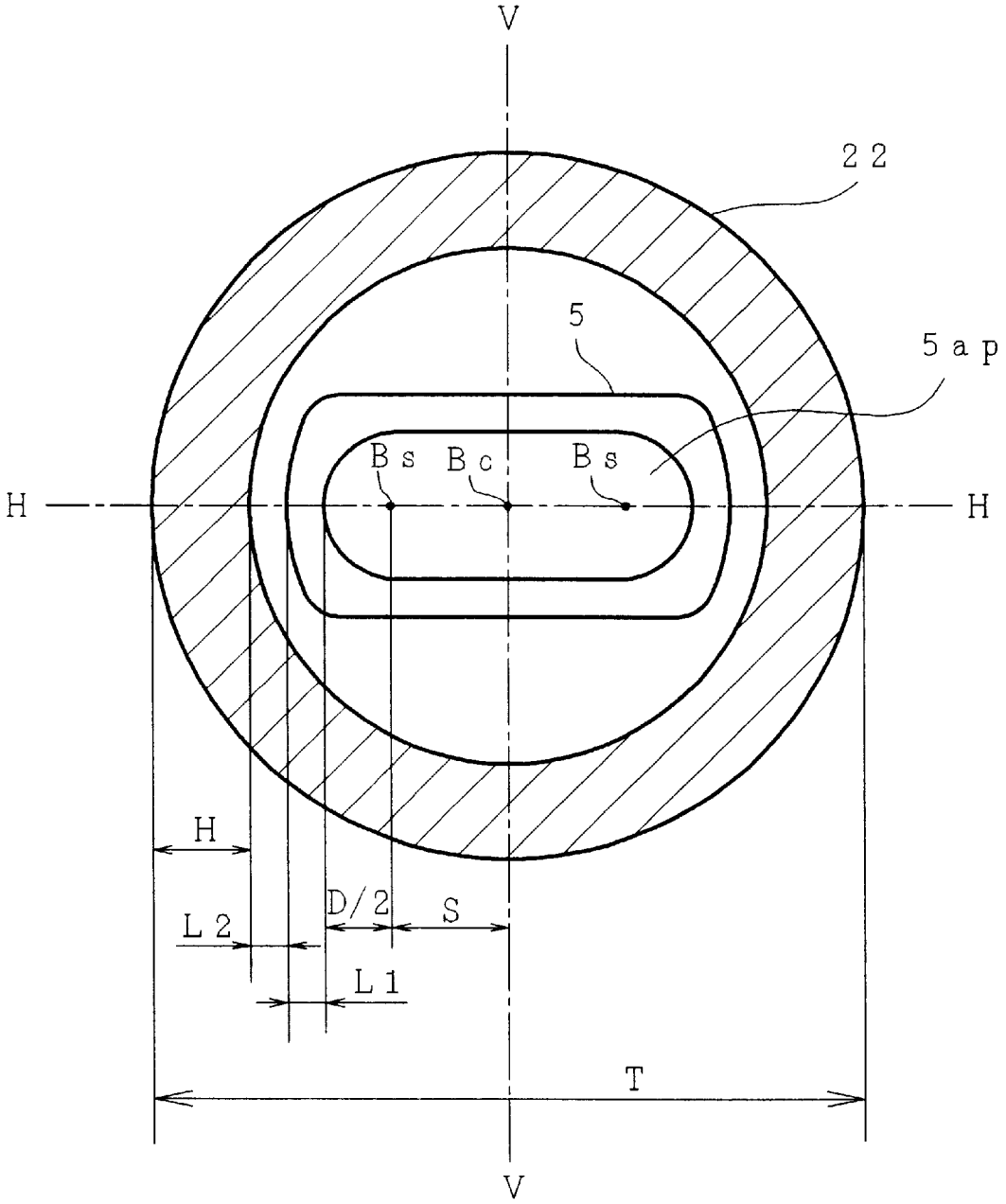
FIG. 10 is a cross sectional view of an electrode constituting a main lens and having a single opening with a diameter in a horizontal direction being longer than a diameter perpendicular to it and a neck portion housing the main lens of a cathode ray tube.

FIG. 10 is a cross sectional view of an electrode constituting a main lens and having a single opening with a diameter in a horizontal direction being longer than a diameter perpendicular to it and a neck portion housing the main lens of a cathode ray tube. Numeral 5 indicates a second focus electrode having a single opening 5*ap,* 22 a neck portion, Bs, Bc, and Bs trajectories of three electron beams (Bs indicates a side electron beam and Bc indicates a center electron beam), H—H a horizontal direction, and V—V a vertical direction.

In the figure, the outer diameter T of the neck portion 22 is expressed as follows:

$$T=(S+D/2+L1+L2+H)\times 2$$

where a symbol S indicates a center-to-center spacing between trajectories of adjacent electron beams, D a value of twice the distance from the center of the trajectory of the side beam Bs among the three electron beams to the vertical edge of the opening 5*ap,* L1 an electrode rim width adjacent to the vertical edge of the opening 5*ap,* L2 the distance from the electrode to the inner wall of the neck portion, and H a glass thickness of the neck portion.

The value of D/2 indicates the closest distance from the trajectory center of the side beam Bs to the vertical edge of the opening 5*ap* in the horizontal direction, and it is equivalent to the minimum effective radius of the main lens.

Figure 8:
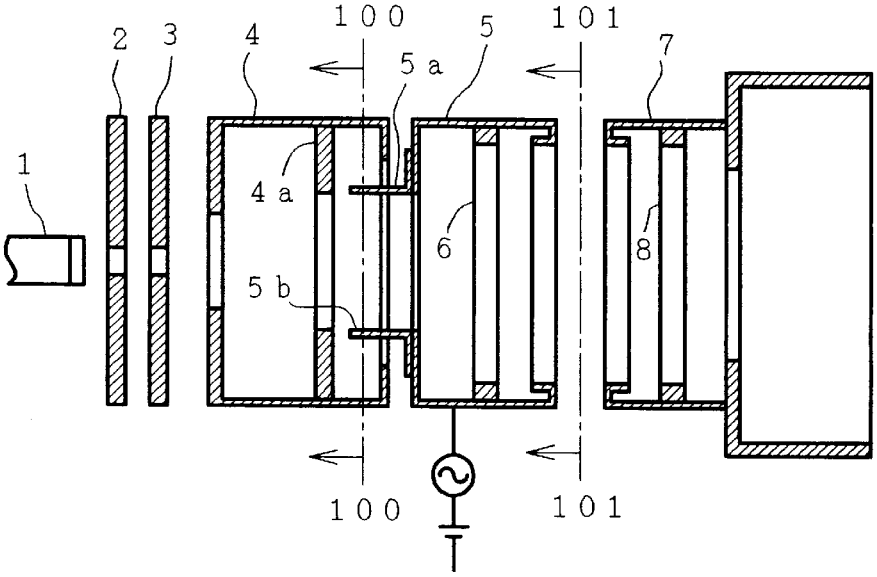
FIG. 8 PRIOR ART
FIG. 8 is a schematic view illustrating the electrode constitution of an in-line electron gun used in a cathode ray tube.
Figure 9A:
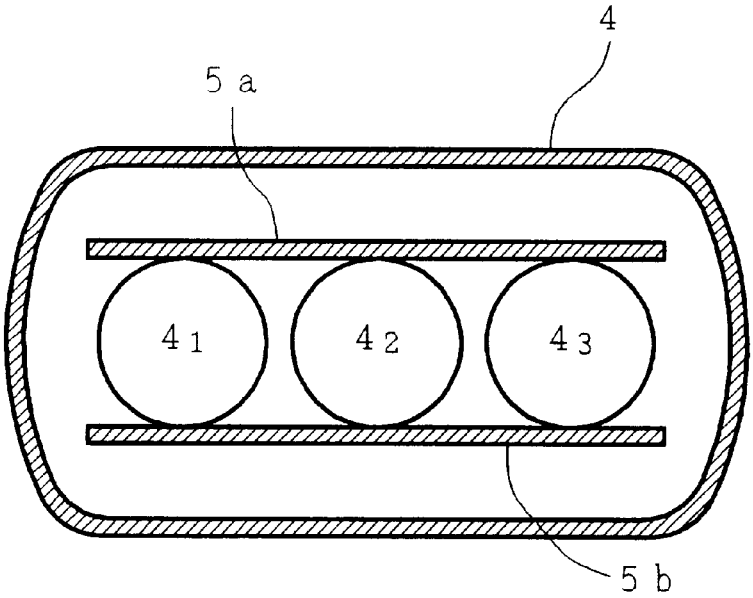
FIG. 9A PRIOR ART
FIG. 9A is a cross sectional view of the electron gun taken along the line 100—100 of FIG. 8.
Figure 9B:
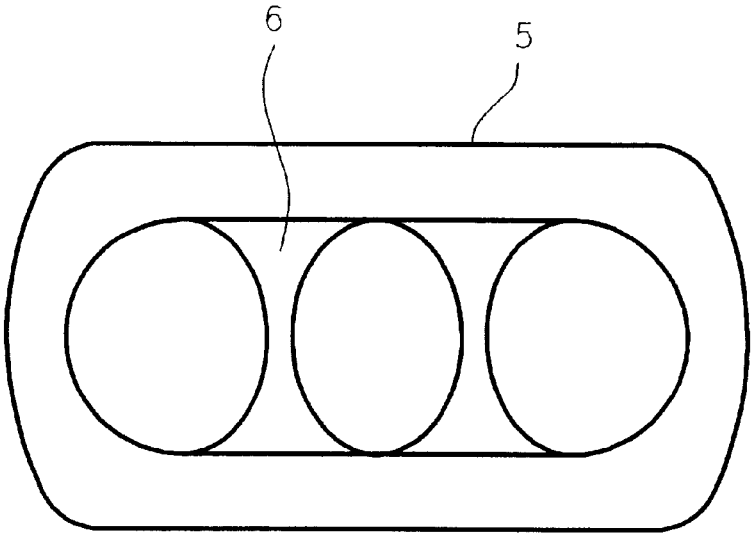
FIG. 9B PRIOR ART
FIG. 9B is a cross sectional view of the electron gun taken along the line 101—101 of FIG. 8.

In the main lens of the electron gun having the constitution shown in FIG. 8, the position of the plate electrode 6 along the tube axis and shapes of the elliptical openings are designed so that the radii of the main lens associated with the center and side electron beams effectively equal (balance with) the aforementioned value of D/2 in all directions.

The reason is that when the effective horizontal diameter and vertical diameter of the main lens are imbalanced, the focus characteristic is degraded in the portion.

Therefore, the diameter of the main lens of the electron gun of the constitution shown in FIG. 8 is generally determined effectively by the value of D.

To decrease the outer diameter of the neck portion, it is necessary to decrease each size mentioned above. However, if the value of S mentioned above is excessively decreased, it is necessary to widen the q dimension, that is, the spacing between the shadow mask and the phosphor screen. Since the space between the shadow mask and the phosphor screen is not shielded magnetically, if the q dimension is increased, the electron beams are deflected by the effect of an external magnetic field such as the Earth's magnetic field, excite a phosphor other than the intended phosphor and cause a problem of degrading color purity.

If the value of D is decreased, the effective diameter of the main lens is decreased and a problem arises that the focus characteristic is degraded and the resolution deteriorates.

Decreasing of the electrode rim width L1 in the horizontal direction is also limited from a viewpoint of its manufacture.

Furthermore, a problem arises that if the distance L2 from the electrode to the inner wall of the neck is decreased, high voltage stability is degraded and if the thickness H of the neck glass is decreased, the mechanical strength is reduced.

An object of the present invention is to solve the aforementioned problems of the prior arts and to provide a cathode ray tube in which the deflection sensitivity is improved by decreasing the outer neck diameter without degrading the focus characteristic, high voltage stability, and mechanical strength and the power consumption for deflection is reduced.

To accomplish the above object, a cathode ray tube of one embodiment of the present invention comprises at least an evacuated envelope comprising a panel portion having a phosphor screen on an inner surface thereof, a neck portion, a funnel portion connecting the panel portion and the neck portion, a deflection device mounted in a vicinity of a transition region between the funnel portion and the neck portion, and an in-line electron gun housed in the neck portion, the in-line electron gun including an electron beam generating section comprising at least a cathode, a control electrode and an accelerating electrode and for generating and directing three electron beams in a horizontal plane toward the phosphor screen, a main lens section comprising, a focus electrode including, a sub-electrode having a single opening at one end thereof for passing the three electron beams, the single opening having a diameter larger in a horizontal direction than a diameter thereof in a vertical direction, and a plate electrode placed inside the sub-electrode and forming apertures for passing the three electron beams respectively, an anode facing the one end of the sub-electrode, the sub-electrode and the anode forming a main lens therebetween, and an electrostatic quadrupole lens, lens strength thereof being varied with application thereon of a voltage varying with an increase in a deflection angle of the three electron beams, wherein a distance from the main lens to the phosphor screen is not larger than 300 mm, an outer diameter T of the neck portion housing the in-line electron gun satisfies the following inequality:

$23.2\ \text{mm} \leqq T \leqq 25.9\ \text{mm}$, and a value D of twice a distance from a center of a trajectory of a side electron beam of the three electron beams to a horizontal edge of the single opening satisfies the following inequality:

$5.0\ \text{mm} \leqq D \leqq 6.5\ \text{mm}$, and a cathode ray tube of another embodiment of the present invention comprises at least an evacuated envelope comprising a panel portion having a phosphor screen on an inner surface thereof, a neck portion, a funnel portion connecting the panel portion and the neck portion, a deflection device mounted in a vicinity of a transition region between the funnel portion and the neck portion, and an in-line electron gun housed in the neck portion, the in-line electron gun including an electron beam generating section comprising at least a cathode, a control electrode and an accelerating electrode and for generating and directing three electron beams in a horizontal plane toward the phosphor screen, a main lens section comprising, a focus electrode including, a sub-electrode having a single opening at one end thereof for passing the three electron beams, the single opening having a diameter larger in a horizontal direction than a diameter thereof in a vertical direction, and a plate electrode placed inside the sub-electrode and forming apertures for passing the three electron beams respectively, an anode facing the one end of the sub-electrode, the sub-electrode and the anode forming a main lens therebetween, and an electrostatic quadrupole lens, lens strength thereof being varied with application thereon of a voltage varying with an increase in a deflection angle of the three electron beams, wherein a distance from the main lens to the phosphor screen is not larger than 300 mm, an outer diameter T of the neck portion housing the in-line electron gun and a value D of twice a distance from a center of a trajectory of a side electron beam of the three electron beams to the vertical edge of the single opening satisfies the following inequalities:

$D+18.2\ \text{mm} \leqq T \leqq D+19.4\ \text{mm}$, and $5.0\ \text{mm} \leqq D \leqq 6.5\ \text{mm}$.

DETAILED DESCRIPTION OF THE PREFERRED EMBODIMENTS

In FIG. 10, the outer neck diameter T of a cathode ray tube is expressed by $T=(S+D/2+L1+L2+H)\times 2$. In the formula, a symbol S indicates a center-to-center spacing between trajectories of adjacent electron beams, D a value of twice the distance from the center of the trajectory of the side electron beam Bs among the three electron beams to the vertical edge of the opening of the electrode 5 which is nearly equal to the effective diameter of the main lens, L1 a rim width in the horizontal direction of the electrode 5 having the opening 5*ap,* L2 the distance from the electrode 5 to the inner wall of the neck 22, and H a thickness of the glass neck 22. The rim width L1 of the electrode 5 having the opening 5*ap* is generally within a range from 1.0 to 1.5 mm and it is difficult to make it smaller than 1.0 mm from a viewpoint of manufacturing the electrode by press-forming.

It is difficult to make the distance L2 from the electrode 5 to the inner wall of the neck 22 smaller than 1.0 mm from a viewpoint of high voltage stability and the distance from electrodes to the inner wall of a neck in a conventional color cathode ray tube is within a range from 1.0 to 1.3 mm.

It is difficult to make the thickness of the glass neck smaller than 2.5 mm from a viewpoint of the mechanical strength and the thickness of the glass neck of a conventional color cathode ray tube is within a range from 2.5 to 2.8 mm.

To minimize the outer neck diameter T, it is necessary to reduce the above values as much as possible.

The center-to-center spacing between adjacent electron beams will be explained hereunder.

Figure 3:
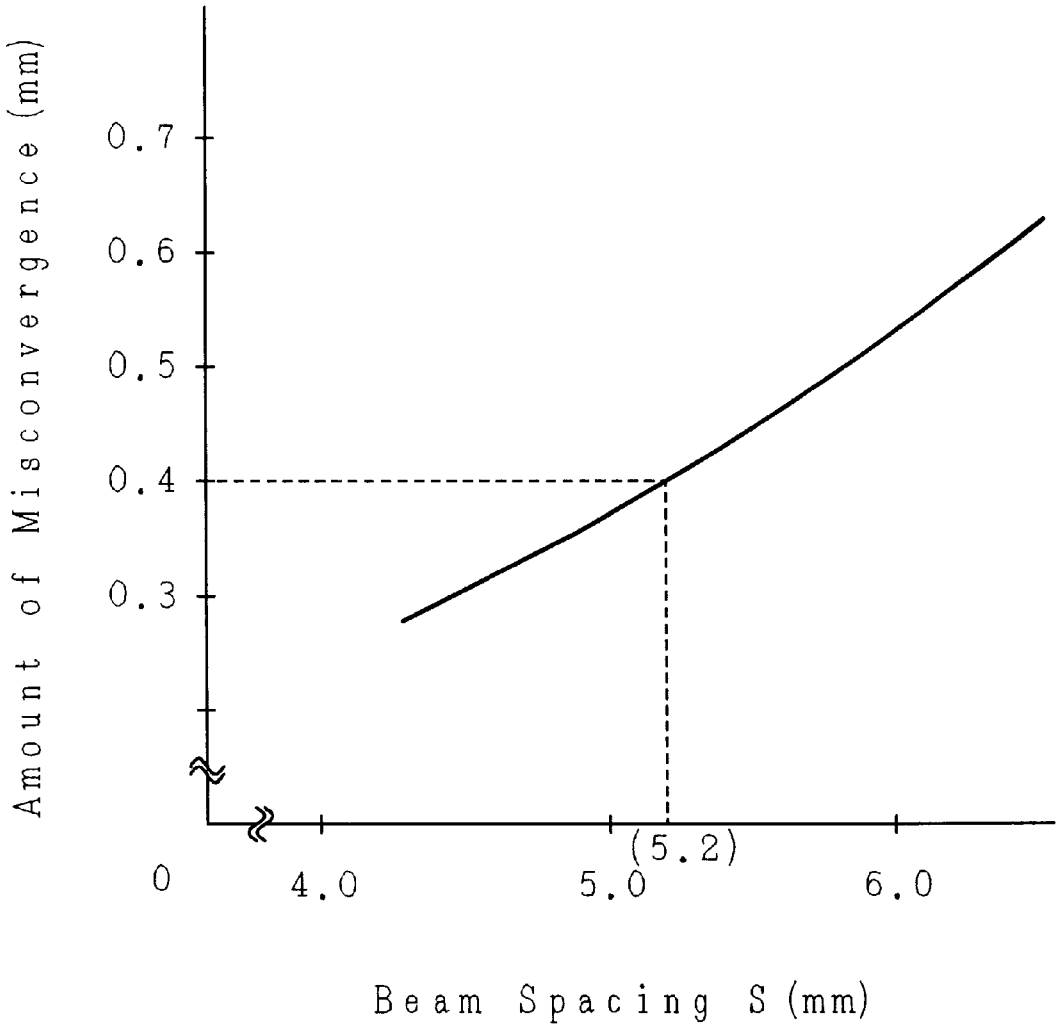
FIG. 3 is an illustration of the relation between the center-to-center spacing S between adjacent electron beams and the amount of misconvergence.

FIG. 3 is an illustration of the relation between the center-to-center spacing S between adjacent electron beams and the amount of misconvergence in a high definition color cathode ray tube having a deflection angle of 90° and the abscissa indicates the beam spacing S (mm) and the ordinate indicates the amount of misconvergence (mm).

It is necessary for a color cathode ray tube to converge three electron beams on the phosphor screen. However, the three electron beams do not converge perfectly on the phosphor screen due to tolerances of the electron gun, the deflection yoke and the assembly of the color cathode ray tube. The distance by which the three electron beams are misregistered on the phosphor screen is referred to as the amount of misconvergence. The curve shown in FIG. 3 indicates mean values of microconnvergence and the amount of misconvergence scatters generally within about 0.1 mm from the mean values due to tolerances of manufacture and parts.

FIG. 3 shows that in a high definition color cathode ray tube, since the amount of misconvergence must be 0.4 mm at most, it is necessary that the center-to-center spacing between adjacent electron beams is 5.2 mm at most.

In a color cathode ray tube, it is necessary that three electron beams excite only one of the phosphors of R, G, and B corresponding to each of them so as to emit light.

However, when the effect of the Earth's magnetic field on the electron beams is changed by rotating the axis of the color cathode ray tube and each electron beam is deflected off the intended trajectory thereof, if the spacing between each color phosphor element is narrow, not only the intended color phosphor element but also an unintended color phosphor element is excited and emits light.

The difference between the spacing between adjacent color phosphor elements and the shift amount of the beam spot position due to unwanted deflection of the electron beams is defined as a beam landing error tolerance.

Figure 4:
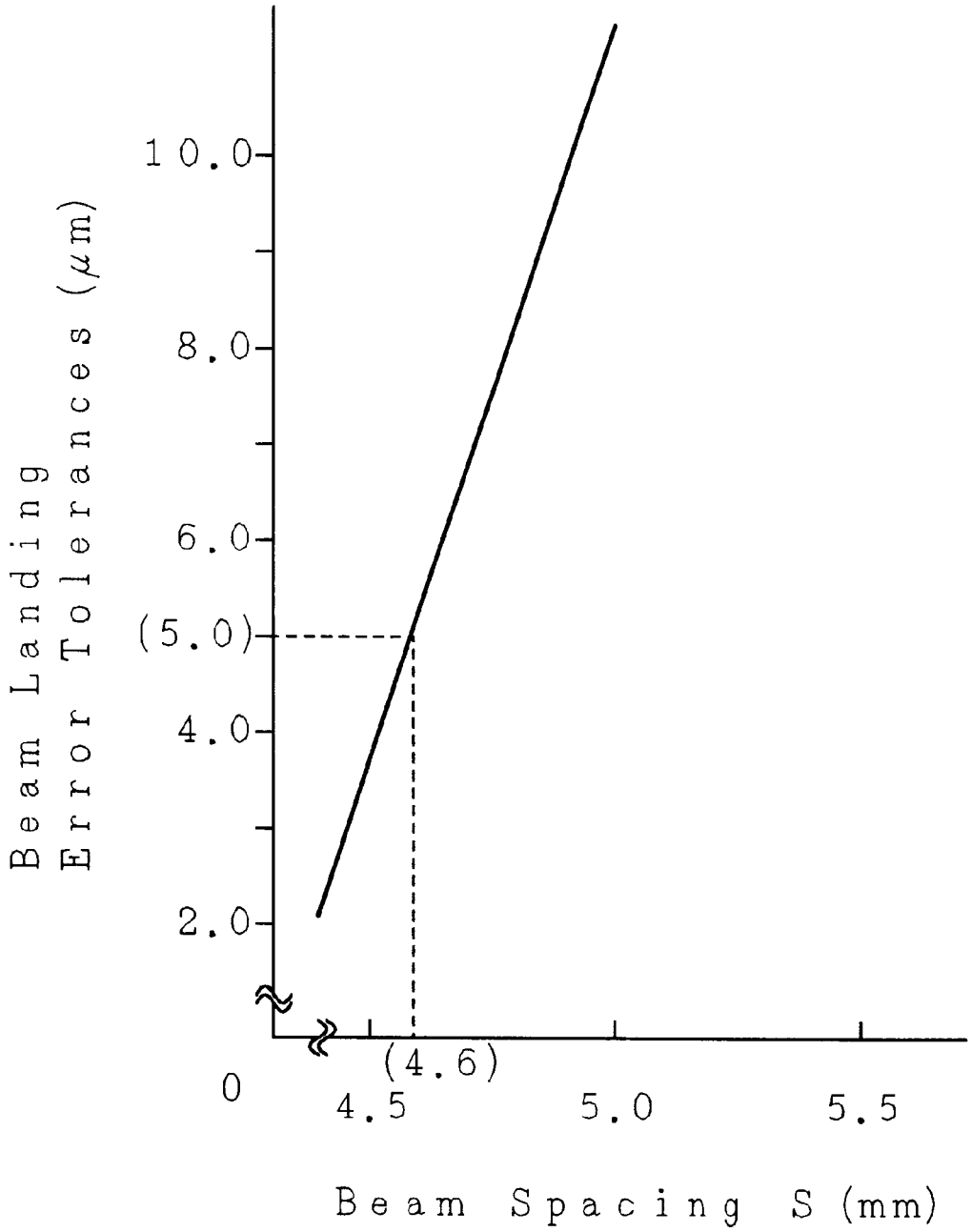
FIG. 4 is an illustration of the relation between the center-to-center spacing S between adjacent electron beams and the beam landing error tolerance when the tube axis of a high definition color cathode ray tube (dot pitch of 0.28 mm) is rotated from the east-to-west direction to the south-to-north direction

FIG. 4 is an illustration of the relation between the center-to-center spacing S between adjacent electron beams and the beam landing error tolerance when the axis of a high definition color cathode ray tube of a deflection angle of 90° (dot pitch of 0.28 mm) is rotated from the east-to-west direction to the south-to-north direction.

In consideration of manufacturing tolerances in a color cathode ray tube, the beam landing error tolerance must be designed to be at least 5.0 $\mu$m. Therefore, from FIG. 4, it is necessary to set S to be at least 4.6 mm.

From the above explanations, the value of S is to be within the following range.

$$4.6\ \text{mm} \leqq S \leqq 5.2\ \text{mm} \quad (1)$$

The minimum value of the value D of twice the distance from the center of the trajectory of the side electron beam Bs to the vertical edge of the electrode aperture 5*ap* is defined as $D_{min}$ and the maximum value thereof is defined as $D_{max}$. The outer neck diameter T is expressed as $T=(L1+L2+H+S)\times 2+D$ as mentioned above. When S is varied within the aforementioned range after substituting the minimum values L1=1.0, L2=1.0, and H=2.5 for L1, L2, and H, respectively, the following relation is obtained.

$$D_{min}+18.2\ \text{mm} \leqq T \leqq D_{max}+19.4\ \text{mm} \quad (2)$$

Therefore, by reducing the value of D, the outer neck diameter can be reduced.

Next, the D dimension for giving the effective diameter of the main lens will be explained.

Figure 5:
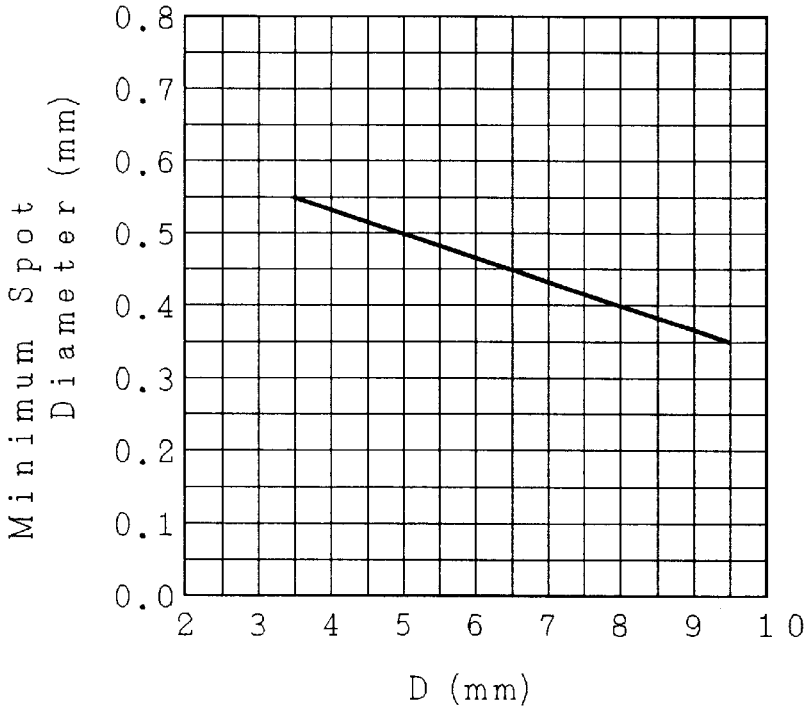
FIG. 5 is an illustration of the analytically obtained relationship between the effective diameter D of a main lens and the minimum spot diameter obtainable in a color cathode ray tube with a useful screen diagonal of 41 cm and a deflection angle of 90°.

FIG. 5 is an illustration of the analytically obtained relation between the effective diameter D of a main lens and the minimum beam spot diameter of a color cathode ray tube with a useful screen diagonal of 41 cm and a deflection angle of 90°. The abscissa indicates the D dimension (mm) and the ordinate indicates the minimum spot diameter (mm).

The analytical conditions are usual ones with an electron beam current Ik=100 $\mu$A and anode voltage=26 kV.

In a color cathode ray tube of this size, the distance from the main lens to the phosphor screen is generally about 290±10 mm.

As the value of D increases, the spherical aberration of the main lens reduces and the minimum spot diameter obtained by the main lens decreases. However, a problem arises that if the beam spot diameter becomes smaller than a certain value, moire is generated.

The moire means a phenomenon that the periodic structure of phosphor dots interferes with scanning lines of electron beams or a periodic video signal, generates stripe patterns on the screen and degrades the resolution.

Figure 6:
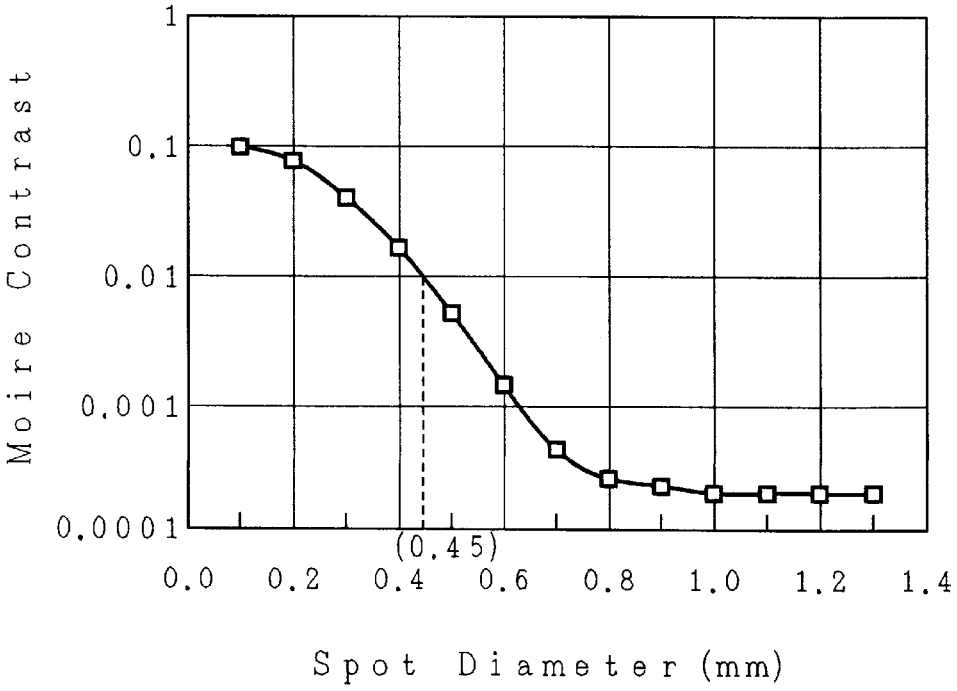
FIG. 6 is an illustration of the analytically obtained relationship between the spot diameter and the contrast of moire due to interference with scanning lines.

FIG. 6 is an illustration of the analytically obtained relationship between the spot diameter and the contrast of moire due to the interference of scanning lines.

The abscissa indicates the spot diameter (mm) and the ordinate indicates the moire contrast.

When a display of a uniform raster signal is provided on the screen and the maximum and the minimum of the brightness distribution caused by the moire are indicated as $B_{max}$, $B_{min}$, respectively, a moire contrast is defined as $(B_{max}-B_{min})/(B_{max}+B_{min})$. It was confirmed by experiments that the moire can be perceived when the moire contrast becomes equal to or higher than 0.01 and it is necessary that the spot diameter is equal to or larger than 0.45 mm.

In a color cathode ray tube, it is necessary to obtain a satisfactory resolution on the screen. "In-Line Type High-Resolution Color-Display Tube", National Technical Report, Vol. 28, No. 1, Feb. 1982 discloses that when the useful screen diagonal is 41 cm, and the number of horizontally arranged dots is at least 1000, and the mask pitch is not larger than 0.28 min, it is necessary from the analytical result to set the spot diameter to be equal to or smaller than 0.5 mm at the center of the screen.

Therefore, from FIG. 5, when the spot diameter is between 0.45 mm and 0.5 mm, it is necessary that the value D of twice the distance from the center of the trajectory of the side electron beam to the vertical edge of the opening 5*ap* is set to be at least 5.0 mm but it is necessary to set it to be 6.5 mm at maximum and the following relation is obtained.

$$5.0\ \text{mm} \leqq D \leqq 6.5\ \text{mm} \quad (3)$$

When the above formula (3) is substituted for the aforementioned formula (2), the following condition is obtained for the outer neck diameter.

$$23.2\ \text{mm} \leqq T \leqq 25.9\ \text{mm} \quad (4)$$

When the outer neck diameter T is a value in the neighborhood of the upper limit 25.9 mm, if the effective diameter D of the main lens is reduced a little from 6.5 mm and the distance L2 from the electrode to the inner wall of the neck is enlarged, high voltage stability can be improved. If the rim width in the horizontal direction L1 of the electrode forming the aforementioned opening is enlarged, the manufacture of the electrode becomes easy.

Figure 11:
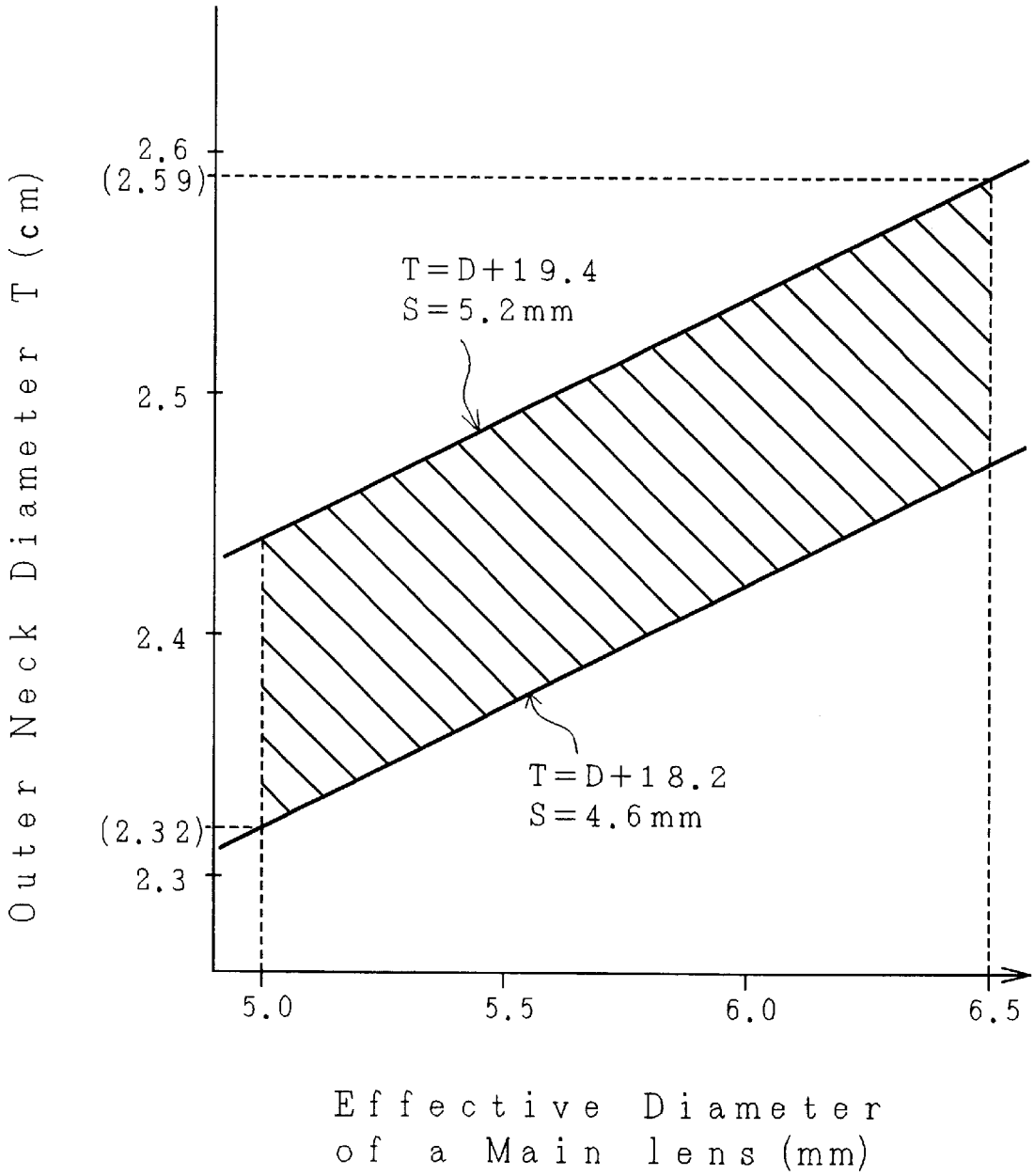
FIG. 11 is an illustration of the relation between the outer neck diameter T, the center-to-center spacing S between adjacent electron beams, and the effective diameter D of a main lens.

The relation between T, S, and D is shown in FIG. 11 and the range satisfying the conditions of the formulas (1), (2), and (3) is shown by a hatched area.

Even if the spot diameter at the center of the screen is minimized, the spot diameter at the screen corners is enlarged by deflection aberration and the resolution at the screen corners is degraded.

Therefore, to ensure the resolution over the entire screen, it is essential to employ dynamic focusing with an electrostatic quadrupole lens in an electron gun and prevent the resolution at the screen corners from degradation.

However, the restrictions of the aforementioned formulas (3) and (4) are not realized when the distance from the main lens to the phosphor screen is 300 mm or more.

In the case of a color cathode ray tube with a useful screen diagonal of 51 cm and a deflection angle of 90°, the distance from the main lens to the phosphor screen is about 354 mm. If this distance is within a range from 300 to 354 mm, a desirable value of the effective diameter of the main lens exists between 6.5 mm and 8.0 mm and the outer neck diameter T can be reduced compared with the conventional value of 29.1 mm. However, in a high-definition color monitor cathode ray tube for use in an information terminal as of a computer, the size in this range is not adopted as the standard type and a reduction in the outer neck diameter of cathode ray tubes of this kind by application of the present invention does not provide a large advantage. Therefore, it is effective when the distance from the main lens to the phosphor screen is 300 mm or less.

Figure 7:
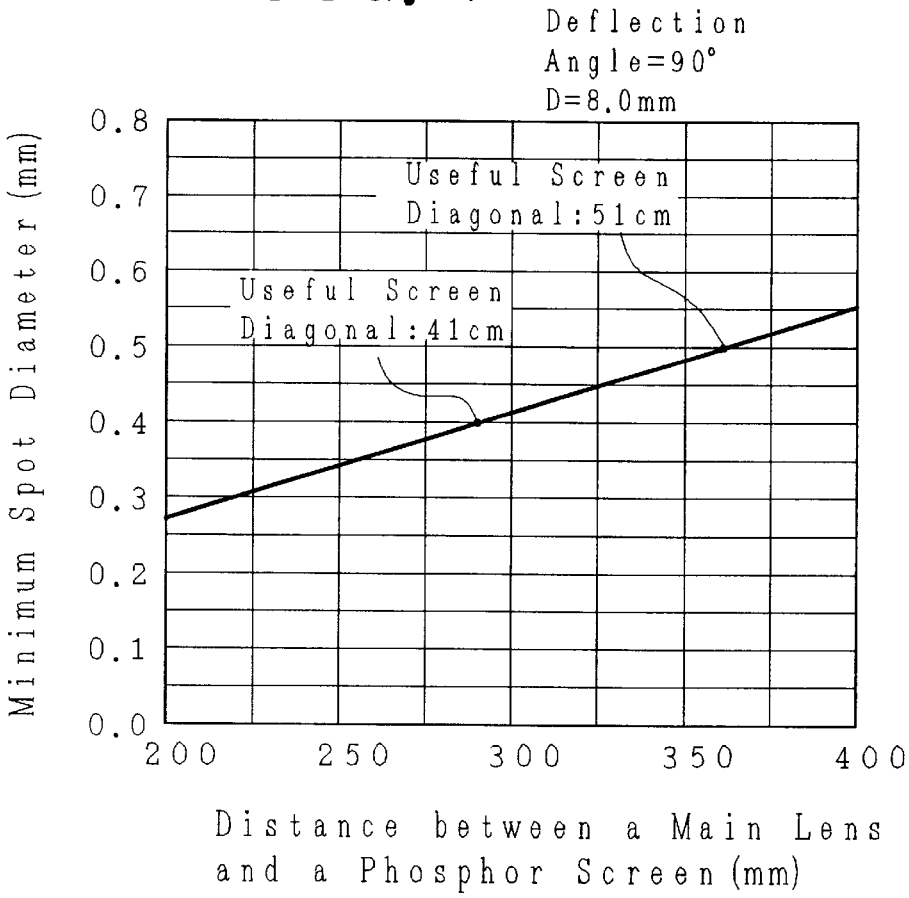
FIG. 7 is an illustration of the relation between the distance from the main lens to the screen and the minimum spot diameter when the effective diameter of the main lens is a conventional value of 8.0 mm.

FIG. 7 is an illustration of the relation between the distance from the main lens to the phosphor screen and the minimum spot diameter when the effective diameter of the main lens is set to be a conventional value of 8.0 mm. The abscissa indicates the distance from the main lens to the screen and the ordinate indicates the minimum spot diameter (mm).

In FIG. 7, when the useful screen diagonal is 41 cm, the minimum spot diameter is 0.4 mm. When the useful screen diagonal is 51 cm, the minimum spot diameter is 0.5 mm and is equal to the spot diameter necessary to obtain a good resolution on the screen and the moire is little perceived.

Therefore, when the useful screen diagonal is 51 cm and the deflection angle is 90°, it is difficult to make the effective diameter D of the main lens smaller than a conventional value of 8.0 mm, so that it is also difficult to make the outer neck diameter smaller than the conventional one.

The embodiment of the present invention will be explained in detail hereunder with reference to the accompanying drawings.

Figure 1:
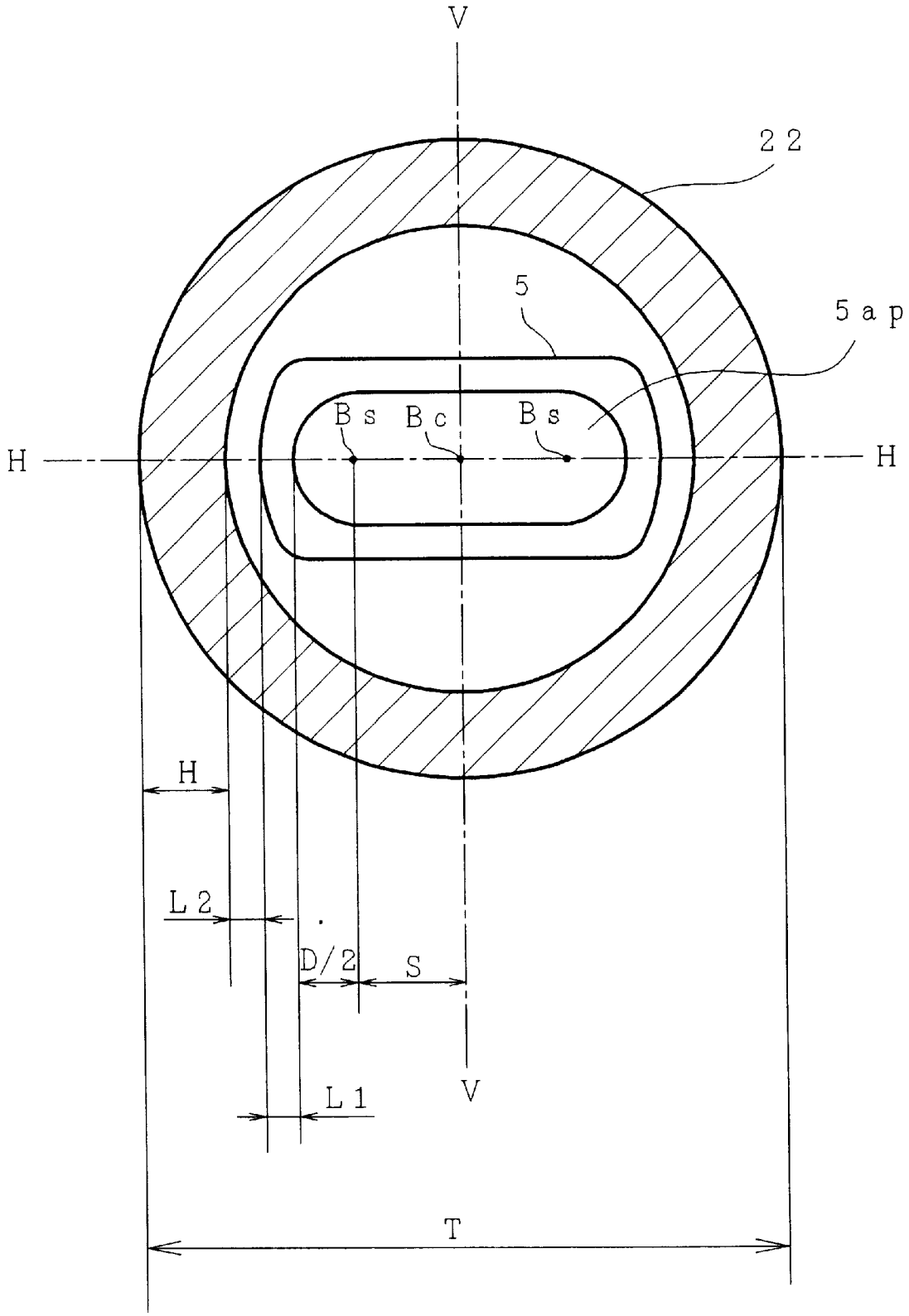
FIG. 1 is a cross sectional view showing the electrode portion constituting the main lens of an electron gun and a neck used in a cathode ray tube of the present invention.

FIG. 1 is a cross sectional view showing the electrode portion constituting the main lens of an electron gun and a neck portion in a cathode ray tube of the present invention. Numeral 5 indicates a second focus electrode having a single opening 5*ap* through which three electron beams pass, 22 a neck portion, Bs, Bc, and Bs trajectories of three electron beams (Bs indicates a side electron beam and Bc indicates a center electron beam), H—H a horizontal direction, and V—V a vertical direction.

In the figure, assuming that the center-to-center spacing S between adjacent electron beams is 4.75 mm, and the value D of twice the distance from the center of the trajectory of the side electron beam Bs to the vertical edge of the opening 5*ap* is 5.5 mm, and the rim width in the horizontal direction L1 adjacent to the vertical edge of the opening 5*ap* is 1.0 mm, and the distance L2 from the electrode 5 to the inner wall of the neck 22 is 1.0 mm, and the thickness H of the glass neck 22 is 2.5 mm, the outer neck diameter T is expressed by the following formula from FIG. 1:

$$\begin{aligned} T &= (S + D/2 + L1 + L2 + H) \times 2 \\ &= (4.75 + 5.5/2 + 1.0 + 1.0 + 2.5) \times 2 \\ &= 24.0 \end{aligned}$$

and satisfies the following equation:

$$23.2\ \text{mm} \leqq T \leqq 25.9\ \text{mm} \quad (4)$$

Furthermore, the value D of twice the distance from the centers of the trajectories of the side electron beams Bs and Bs among the three electron beams Bs, Bc, and Bs to the vertical edges of the opening 5*ap* is 5.5 mm and satisfies the following equation:

$$5.0\ \text{mm} \leqq D \leqq 6.5\ \text{mm} \quad (3)$$

Figure 2:
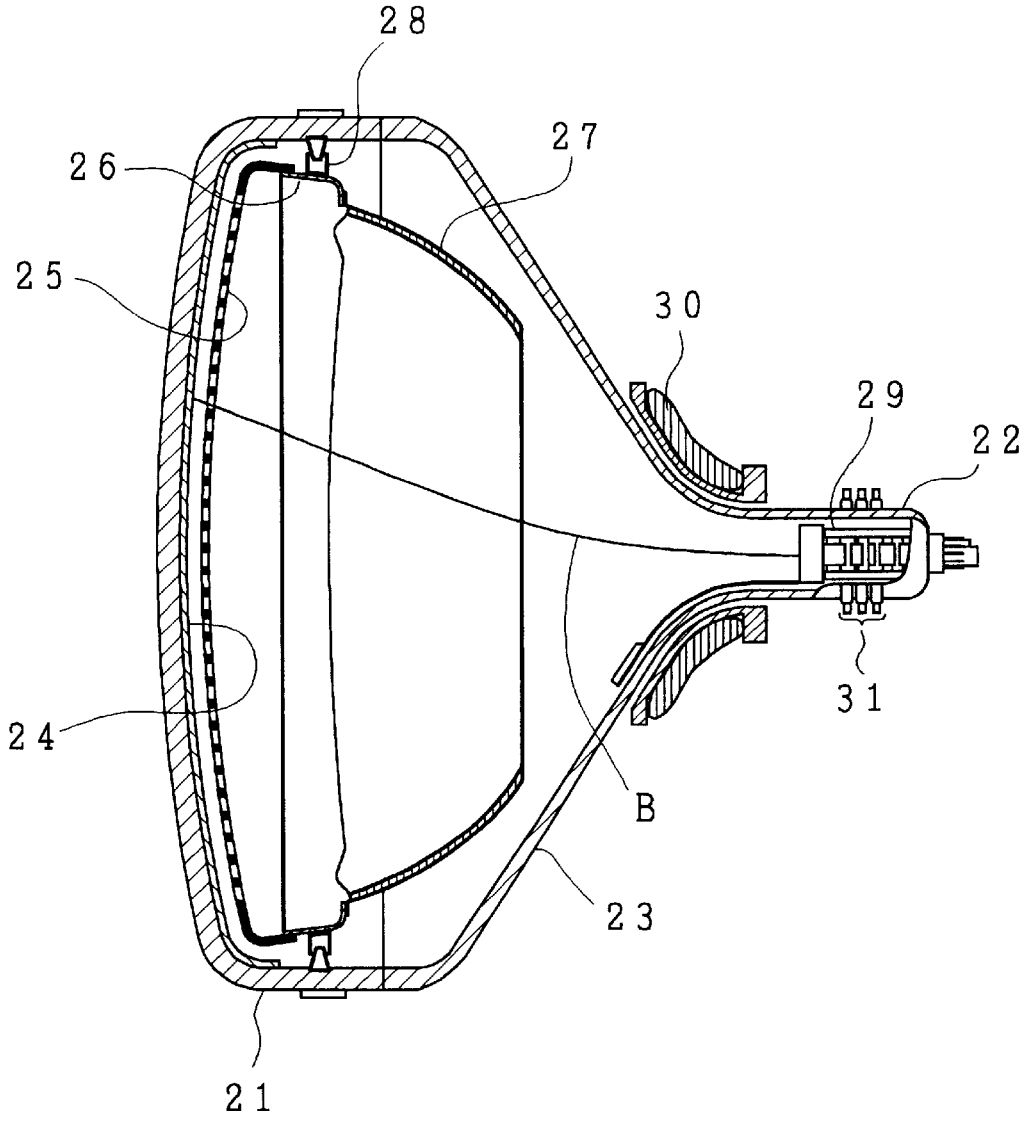
FIG. 2 is a cross sectional view of a color cathode ray tube for illustrating an embodiment of a cathode ray tube of the present invention.

FIG. 2 is a cross sectional view of a color cathode ray tube for illustrating an embodiment of a cathode ray tube of the present invention. Numeral 21 indicates a panel portion constituting a display screen, 22 a neck portion housing an electron gun, 23 a funnel portion connecting the panel portion and the neck portion, 24 a phosphor screen which is formed on the inner surface of the panel portion and constitutes a display screen, 25 a shadow mask, 26 a mask frame for holding the shadow mask, 27 a magnetic shield for shielding an external magnetic field, 28 a suspension spring, 29 an electron gun of the present invention mentioned above, 30 a deflection yoke, 31 magnets for centering of electron beams and correcting color purity, and B three in-line electron beams (Bs, Bc, and Bs).

In the figure, a color cathode ray tube of this kind has an evacuated envelope comprising the panel portion 21 having the phosphor screen 24 on its inner wall, the neck portion 22 housing the electron gun 29, and the funnel portion 23 connecting the panel portion and the neck portion.

The electron gun 29 housed in the neck portion 22 has the aforementioned structure and emits three in-line electron beams toward the phosphor screen 24.

The deflection device mounted in the transition region between the funnel portion and the neck portion of the evacuated envelope deflects the three electron beams emitted from the electron gun 29 in both the horizontal and vertical directions of the phosphor screen 24 and the three electron beams are subjected to color selection by the shadow mask 25 and impinge on the phosphor screen 24 so as to form a color picture.

The shadow mask 25 is welded to the mask frame 26 ~d fitted in predetermined spaced relationship with the phosphor screen 24 by engaging the suspension springs 28 fixed at the periphery of the mask frame 26 with panel pins embedded in the inner wall of the panel portion 21.

The cathode ray tube of this embodiment provides a picture of high resolution over the entire screen.

The present invention is not limited to the aforementioned embodiments. Needless to say, it can be applied to various electron guns of other types, cathode ray tubes and color cathode ray tubes having such electron guns, and other cathode ray tubes.

As explained above, according to the present invention, the outer neck diameter can be reduced compared with the conventional one without degrading the focus characteristic, high voltage stability, and mechanical strength, and the deflection sensitivity of the deflection yoke is improved, and the power consumption for deflection is reduced, so that a cathode ray tube of high picture quality can be provided.

What is claimed is:

1. A cathode ray tube comprising at least an evacuated envelope comprising a panel portion having a phosphor screen on an inner surface thereof, a neck portion, a funnel portion connecting said panel portion and said neck portion, a deflection device mounted in a vicinity of a transition region between said funnel portion and said neck portion, and an in-line electron gun housed in said neck portion, said in-line electron gun including an electron beam generating section comprising at least a cathode, a control electrode and an accelerating electrode and for generating and directing three electron beams in a horizontal plane toward said phosphor screen, a main lens section comprising a focus electrode comprising a plurality of sub-electrodes, one of said plurality of sub-electrodes having a single opening at one end thereof for passing the three electron beams, said single opening having a diameter larger in a horizontal direction than a diameter thereof in a vertical direction, and a plate electrode placed inside said one of said plurality of sub-electrodes and forming apertures for passing the three electron beams respectively, an anode facing said one end of said one of said sub-electrodes, said one of said plurality of sub-electrodes and said anode forming a main lens therebetween, said plurality of sub-electrodes further forming an electrostatic quadrupole lens disposed upstream of said main lens, and lens strengths of said main lens and said quadrupole lens being varied with a voltage applied to said one of said plurality of sub-electrodes and varying with an increase in a deflection angle of the three electron beams, wherein a distance from said main lens to said phosphor screen is not larger than 300 mm, an outer diameter T of said neck portion housing said in-line electron gun satisfies a following inequality:

$$23.2\ \text{mm} \leqq T \leqq 25.9\ \text{mm, and}$$

a value D of twice a distance from a center of a trajectory of a side electron beam of the three electron beams to a vertical edge of said single opening satisfies a following inequality:

$$5.0\ \text{mm} \leqq D \leqq 6.5\ \text{mm.}$$

2. A cathode ray tube according to claim 1, wherein said cathode ray tube further comprises a shadow mask suspended within said panel portion, and wherein a dot pitch of apertures in said shadow mask is not larger than 0.28 mm.

3. A cathode ray tube according to claim 1, wherein a spacing S between centers of adjacent electron beams of said three electron beams satisfies the following inequality:

$$4.6\ \text{mm} \leqq S \leqq 5.2\ \text{mm.}$$

4. A cathode ray tube according to claim 1, wherein an electrode rim width L1 measured from said vertical edge of said single opening to a vertical outside surface on a vertical edge side of said one of said plurality of sub-electrodes satisfies the following inequality:

$$1.0\ \text{mm} \leqq L1 \leqq 1.5\ \text{mm.}$$

5. A cathode ray tube according to claim 1, wherein a distance L2 measured from a vertical outside surface of said one of said plurality of sub-electrodes to an inner surface of said neck portion facing said vertical outside surface satisfies the following inequality:

$$1.0\ \text{mm} \leqq L2 \leqq 1.3\ \text{mm.}$$

6. A cathode ray tube comprising at least an evacuated envelope comprising a panel portion having a phosphor screen on an inner surface thereof, a neck portion, a funnel portion connecting said panel portion and said neck portion, a deflection device mounted in a vicinity of a transition region between said funnel portion and said neck portion, and an in-line electron gun housed in said neck portion, said in-line electron gun including an electron beam generating section comprising at least a cathode, a control electrode and an accelerating electrode and for generating and directing three electron beams in a horizontal plane toward said phosphor screen, a main lens section comprising a focus electrode including a plurality of sub-electrodes, one of said plurality of sub-electrodes having a single opening at one end thereof for passing the three electron beams, said single opening having a diameter larger in a horizontal direction than a diameter thereof in a vertical direction, and a plate electrode placed inside said one of said plurality of sub-electrodes and forming apertures for passing the three electron beams respectively, an anode facing said one end of said one of said plurality of sub-electrodes, said one of said plurality of sub-electrodes and said anode forming a main lens therebetween, and said plurality of sub-electrodes further forming an electrostatic quadrupole lens disposed upstream of said main lens, lens strengths of said main lens and said quadrupole lens being varied with a voltage applied to said one of said plurality of sub-electrodes and varying with an increase in a deflection angle of the three electron beams, wherein a distance from said main lens to said phosphor screen is not larger than 300 mm, an outer diameter T of said neck portion housing said in-line electron gun and a value D of twice a distance from a center of a trajectory of a side electron beam of the three electron beams to a vertical edge of said single opening satisfy the following inequalities:

$D+18.2\ \text{mm} \leqq T \leqq D+19.4\ \text{mm}$, and $5.0\ \text{mm} \leqq D \leqq 6.5\ \text{mm}$.

7. A cathode ray tube according to claim 6, wherein said cathode ray tube further comprises a shadow mask suspended within said panel portion, and wherein a dot pitch of apertures in said shadow mask is not larger than 0.28 mm.

8. A cathode ray tube according to claim 6, wherein a spacing S between centers of adjacent electron beams of said three electron beams satisfies the following inequality:

$$4.6\ \text{mm} \leqq S \leqq 5.2\ \text{mm}.$$

9. A cathode ray tube according to claim 6, wherein an electron rim width L1 measured from said vertical edge of said single opening to a vertical outside surface on said vertical edge of said one of said plurality of sub-electrodes satisfies the following inequality:

$$1.0\ \text{mm} \leqq L1 \leqq 1.5\ \text{mm}.$$

10. A cathode ray tube according to claim 6, wherein a distance L2 measured from a vertical outside surface of said one of said plurality of sub-electrodes to an inner surface of said neck portion facing said vertical outside surface satisfies the following inequality:

$$1.0\ \text{mm} \leqq L2 \leqq 1.3\ \text{mm}.$$

* * * * *